US011041320B2

(12) United States Patent
Scott, III et al.

(10) Patent No.: US 11,041,320 B2
(45) Date of Patent: Jun. 22, 2021

(54) METHOD FOR CREATING A PRECAST CONCRETE WALL WITH ADJUSTABLE CONCRETE FORM LINER CONNECTION

(71) Applicant: Innovative Brick Systems, Broomfield, CO (US)

(72) Inventors: William Clare Scott, III, Broomfield, CO (US); Mark A. Scott, Broomfield, CO (US)

(73) Assignee: INNOVATIVE BRICK SYSTEMS, LLC, Broomfield, CO (US)

( * ) Notice: Subject to any disclaimer, the term of this patent is extended or adjusted under 35 U.S.C. 154(b) by 0 days.

(21) Appl. No.: 16/412,099

(22) Filed: May 14, 2019

(65) Prior Publication Data

US 2019/0351579 A1 Nov. 21, 2019

Related U.S. Application Data

(60) Provisional application No. 62/671,652, filed on May 15, 2018.

(51) Int. Cl.

| | |
|---|---|
| ***B28B 7/00*** | (2006.01) |
| ***E04G 9/10*** | (2006.01) |
| ***B28B 7/36*** | (2006.01) |

(52) U.S. Cl.

CPC ..... *E04G 9/10* (2013.01); *B28B 7/0073* (2013.01); *B28B 7/36* (2013.01)

(58) Field of Classification Search

CPC ..... E04G 9/10; B28B 7/0073; B28B 7/0082; B28B 19/0061; B28B 7/0064; E04B 2002/0267; E04B 2002/0269; E04B 2002/0271

USPC ..... 249/15, 16; 52/314, 315

See application file for complete search history.

(56) References Cited

U.S. PATENT DOCUMENTS

| | | | | |
|---|---|---|---|---|
| 777,656 A | | 12/1904 | Banning | |
| 1,147,704 A | | 7/1915 | Bruckner | |
| 1,636,396 A | | 7/1927 | Urschel | |
| 1,788,180 A | | 1/1931 | White | |
| 2,005,030 A | | 6/1935 | Geisinger | |
| 2,178,535 A | | 10/1939 | Willson | |
| 2,241,898 A | * | 5/1941 | Bawtenheimer ..... | E04F 13/147 52/747.12 |
| 2,725,611 A | | 12/1955 | Wissinger | |

(Continued)

FOREIGN PATENT DOCUMENTS

| | | |
|---|---|---|
| DE | 3534114 | 9/1985 |
| GB | 491397 | 9/1938 |

OTHER PUBLICATIONS

Versa Liner drawing, Versa Liner.TM. Versatile Plastic Embedding Sheet, and Innovative Brick brochure, all published prior to Dec. 2001, 7 pages.

(Continued)

*Primary Examiner* — Michael Safavi
(74) *Attorney, Agent, or Firm* — Merchant & Gould P.C.

(57) ABSTRACT

A liner for a form is provided. The form allows for the creation of a precast concrete wall to be formed. The liner allows a building material, for example, brick veneer, to be placed in the liner in a pattern. The pattern may be a soldier course that can formed over openings in the precast concrete wall. When liquid concrete is poured into the mold and then hardens, the concrete holds the building material in place in the pattern produced by the liner.

10 Claims, 6 Drawing Sheets

(56) References Cited

U.S. PATENT DOCUMENTS 2,825,221 A 3/1958 Brouk
3,131,514 A 5/1964 Siek
3,191,796 A 6/1965 Schwartz et al.
3,231,646 A 1/1966 Conder et al.
3,321,883 A 5/1967 Pascucci
3,352,528 A 11/1967 Bernstrom et al.
3,496,694 A 2/1970 Hicks et al.
3,594,968 A 7/1971 Johnson
3,602,476 A * 8/1971 Iragorri ..... B28B 19/0061 249/96
3,694,533 A 9/1972 Kelsey
3,868,801 A 3/1975 Weiner
4,026,083 A * 5/1977 Hoyt ..... E04F 13/0862 52/387
4,055,322 A 10/1977 Cassidy
4,131,406 A 12/1978 Fresquez
4,534,924 A 8/1985 Kariakin
4,548,008 A 10/1985 Maeda
4,644,719 A 2/1987 Salazar
4,662,140 A * 5/1987 Porter ..... E04F 13/0885 52/385
4,681,290 A * 7/1987 Crosbie ..... E04G 21/1841 248/226.11
4,854,100 A 8/1989 La See
4,858,410 A * 8/1989 Goldman ..... E04F 13/0862 52/591.5
4,916,875 A 4/1990 Kashiwagi
4,947,600 A 8/1990 Porter
4,953,337 A 9/1990 Mills
5,009,387 A 4/1991 Scott et al.
5,225,134 A * 7/1993 Nasvik ..... B28B 7/36 249/102
5,232,608 A 8/1993 Mayer
5,268,137 A * 12/1993 Scott ..... B28B 19/0061 249/112
5,311,714 A 5/1994 Passeno
5,328,142 A 7/1994 Weekers
D354,576 S 1/1995 Weinig
5,418,036 A 5/1995 Tokikawa et al.
5,487,526 A 1/1996 Hupp
5,536,557 A 7/1996 Nasvik et al.
5,667,190 A * 9/1997 Scott ..... B28B 19/0061 249/16
5,900,180 A * 5/1999 Scott ..... B28B 19/0061 249/61
5,922,235 A 7/1999 Scott
6,041,567 A 3/2000 Passeno
6,059,257 A 5/2000 Scott
6,129,329 A * 10/2000 Nasvik ..... B28B 7/0073 249/112
6,186,469 B1 * 2/2001 Scott ..... B28B 19/0061 249/16
6,360,505 B1 * 3/2002 Johns ..... E04F 13/147 249/15
D479,614 S 9/2003 Scott
6,666,428 B2 12/2003 Ward
D544,968 S 6/2007 Walters
7,871,054 B2 * 1/2011 Walters ..... B28B 19/0061 249/15
D648,450 S 11/2011 Drummond
8,110,134 B2 2/2012 Scott
8,181,930 B2 * 5/2012 Fasching ..... B28B 19/0061 249/15
D674,517 S 1/2013 Scott
D675,346 S 1/2013 Scott
8,623,257 B2 * 1/2014 Fitzgerald ..... E04F 15/02194 264/299
8,852,724 B2 * 10/2014 Calmes ..... B28B 7/0073 249/16
8,888,067 B1 * 11/2014 Calmes ..... B28B 7/0073 249/15
10,400,461 B2 * 9/2019 Calmes ..... C09J 7/20
10,406,721 B2 * 9/2019 Fitzgerald ..... E04F 21/04
2004/0041074 A1 3/2004 Takagi
2006/0091282 A1 * 5/2006 Walters ..... B28B 19/0061 249/16
2006/0180731 A1 * 8/2006 Scott ..... B29C 66/47 249/15
2006/0249981 A1 11/2006 Heuel et al.
2007/0107333 A1 * 5/2007 Marsh ..... E02D 29/025 52/223.7
2008/0053012 A1 * 3/2008 Scanlan ..... E04G 21/1866 52/204.2
2008/0220268 A1 9/2008 Scott
2009/0100774 A1 4/2009 Fasching et al.
2010/0155569 A1 6/2010 Walters et al.
2010/0326010 A1 * 12/2010 Bouchard ..... E04F 13/0862 52/762
2011/0056165 A1 * 3/2011 Charles, Jr. ..... B28B 7/0073 52/742.14
2011/0073747 A1 3/2011 Walters
2015/0251332 A1 * 9/2015 Fitzgerald ..... E04G 9/10 249/196
2016/0010346 A1 * 1/2016 Calmes ..... E04G 9/10 249/15

OTHER PUBLICATIONS

M Brick—VersaLiner—Data Sheets for Embedded Brick Templates—Innovative Brick System LLC, Publicly available prior to Feb. 2004, 13 pages.
M Brick Innovative Brick System LLC, Installation Guide for the Versa Line System, Publicly available prior to Feb. 2004, 5 pages.
PCT International Search Report for International Application PCT/US2006/002705, dated Aug. 3, 2007, 6 pages.
PCT International Preliminary Report on Patentability in Application PCT/US2006/002705, dated Aug. 28, 2007, 5 pages.

* cited by examiner

METHOD FOR CREATING A PRECAST CONCRETE WALL WITH ADJUSTABLE CONCRETE FORM LINER CONNECTION

CROSS-REFERENCE TO RELATED APPLICATIONS

This application claims the benefit of U.S. Provisional Application No. 62/671,652, currently pending, filed May 15, 2018 and titled "ADJUSTABLE CONCRETE FORM LINER CONNECTION FOR CAST CONCRETE TEXTURES," the disclosure of which is hereby incorporated herein by reference.

SUMMARY

A liner for a form is provided. The form allows for the creation of a precast concrete wall to be formed. The liner allows a building material, for example, brick veneer, to be placed in the liner in a pattern. The pattern may be a soldier course that can formed over openings in the precast concrete wall. When liquid concrete is poured into the mold and then hardens, the concrete holds the building material in place in the pattern produced by the liner.

In the appended figures, similar components and/or features may have the same reference label. Further, various components of the same type may be distinguished by following the reference label by a letter that distinguishes among the similar components. If only the first reference label is used in the specification, the description is applicable to any one of the similar components having the same first reference label irrespective of the second reference label.

DETAILED DESCRIPTION

Pre-cast concrete walls can be formed by pouring liquid concrete into molds. The molds can hold one or more liners.

A liner can temporarily hold and position one or more building materials, for example, brick, stone, tile, etc., in a pattern at a face of the precast concrete wall. One liner can create a field of the building material. A second liner can create a soldier course. A soldier course can be a pattern of two or more pieces of building material arranged substantially lengthwise. Soldier courses can be positioned over openings in the precast concrete wall. Additionally or alternatively, the liner that forms the soldier course can be adjusted or moved in relation to the liner producing the field of building material to best align the soldier course in relation to the field.

Figure 1:
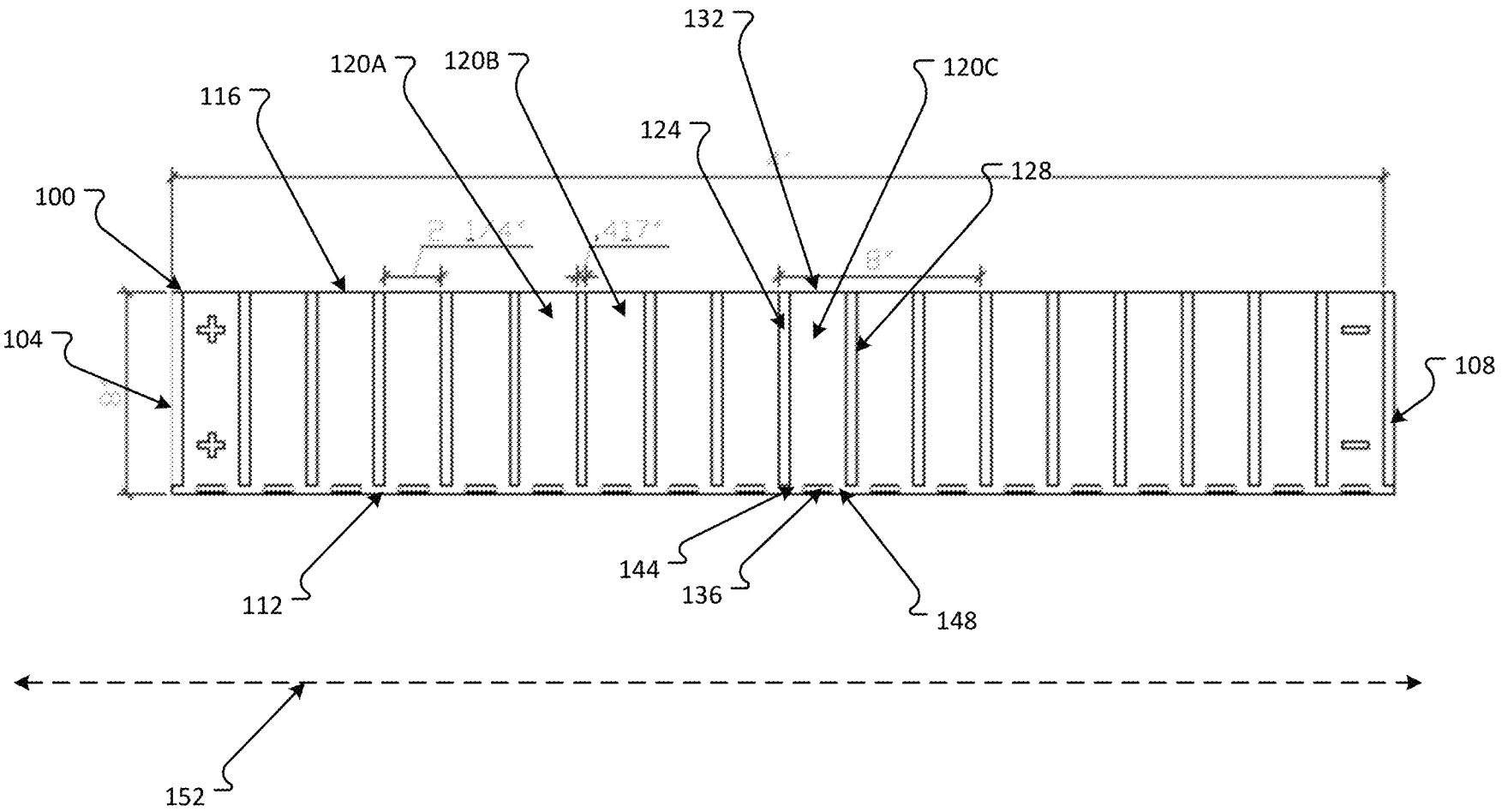
FIG. 1 is a plan view of an adjustable liner for creating a soldier course of bricks, tile, or stone in a cast concrete wall in accordance with embodiments of the present disclosure; other patterns and designs are also possible, for example, wood planking.

An embodiment of a liner 100 may be as shown in FIG. 1. The liner 100 can include a first end 104, a second end 108, a first side 112, and a second side 116. A series of insets 120*a*, 120B, 120C, etc. are created from the first end 104 to the second end 108. The insets 120 can hold parts of a building material, for example, a veneer or thin pieces of brick or stone. The liner 100 may be made similarly to, formed similarly to, and/or function similarly to the liner described in U.S. patent application Ser. No. 11/050,007 and/or U.S. Pat. No. 5,900,180, which are both incorporated by reference herein, for all that they teach and for all purposes.

The insets 120 can be formed by one or more protrusions, formed around a periphery of the insets, which can hold the building material (e.g., brick, tile, or stone) in the inset 120. For example, a first protrusion 124 and second protrusion 128 can hold a brick, tile, or stone along a lengthwise axis. A third protrusion 136 may hold the brick, tile, or stone along a width-wise axis. The fourth side 132 of the inset 120 may not include a protrusion for easier coupling, connecting, and/or mating of the liner 100 with other liners that may form the field of brick, tile, or stone in the precast concrete wall.

The third protrusion 136 may not extend from the first protrusion 124 to the second protrusion 128. Rather, a first space 144 may be created between the third protrusion 136 and the first protrusion 124, and a second space 148 may be created between the third protrusion 136 and the second protrusion 128. The third protrusion 136 can mate, connect, or couple with a similar protrusion on another liner that may form the field of brick, tile, or stone, for example, a liner that creates the field of brick, tile, or stone.

The liner 100 may be adjustable. The liner 100 can be moved along axis 152 in either direction along the axis 152. The movement may be made even if the liner 100 is coupled to other liners on the first side 112 or second side 116. In this way, the soldier course can be adjusted to better fit over window openings, door openings, or create unique and random patterns or configurations. The adjustability ensures that small fragments of brick, tile, or stone will not be needed in the field at the location of the first end 104 or second end 108 of the liner 100 where the field meets the soldier course. The first space 144 and second space 148 allow for easier movement of the liner 100 because there is less friction between the protrusion 136 and the protrusion of the mating liner.

Figure 2:
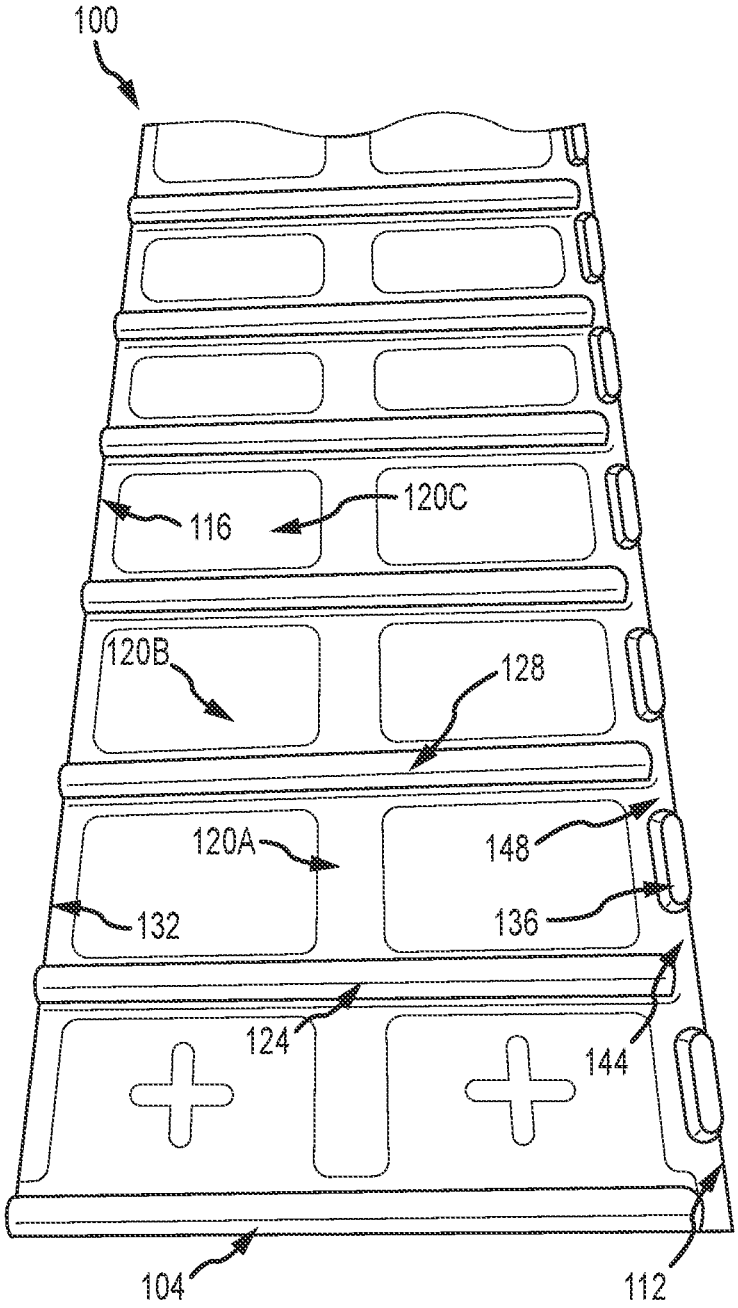
FIG. 2 is a perspective view of the adjustable liner for creating a soldier course of bricks, tile, or stone in a cast concrete wall in accordance with embodiments of the present disclosure.

A perspective view of the liner 100 may be as shown in FIG. 2. From this view, the protrusions 136, 124, and 128 are better shown. The protrusions 136, 124, and 128 can be of various depths depending on the thickness of the brick, tile, or stone to be laid in the insets 120 and the amount of reveal for the finished "grout line" that is created by the protrusions 136, 124, and 128. The cross section of the protrusions 124, 128, 136 may be of any shape, for example, a semi-circle. The width and length of the insets 120 may also change based on the length and width of the brick, tile, or stone to be placed in the inset 120. Still further, the overall length and/or width of the liner 100 may change based on the length and width of the brick or stone to be placed in the insets 120 and on the width of the opening or the configuration of the soldier course. In some configurations, two or more liners 100 can be connected, mated, and/or coupled together to create longer runs of brick, tile, or stone.

Figure 3:
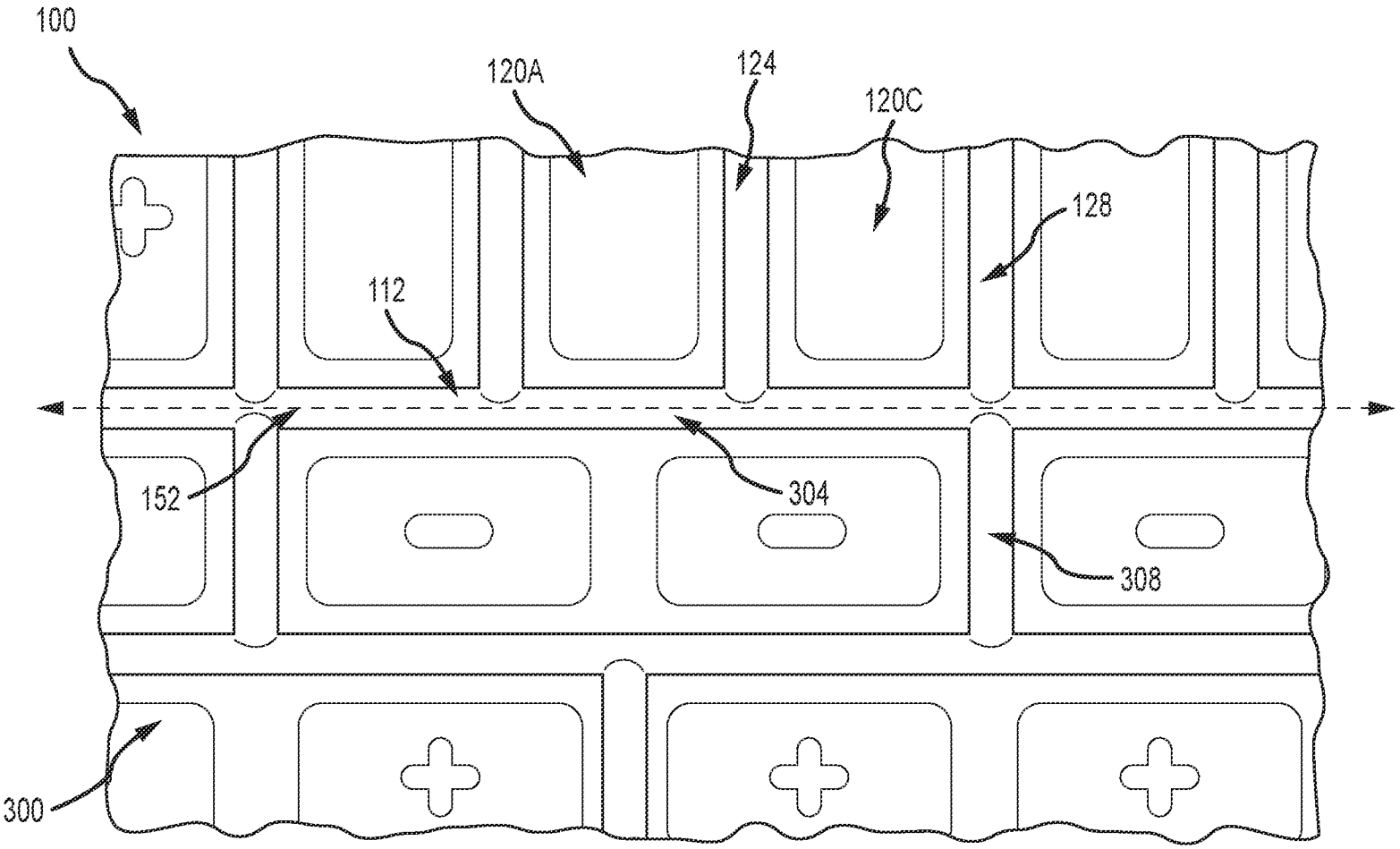
FIG. 3 is a plan view of the adjustable liner, for creating a soldier course of bricks, tile, or stone, coupled or connected to a liner, for a field of bricks, tile, or stone, in a cast concrete wall in accordance with embodiments of the present disclosure.
Figure 4:
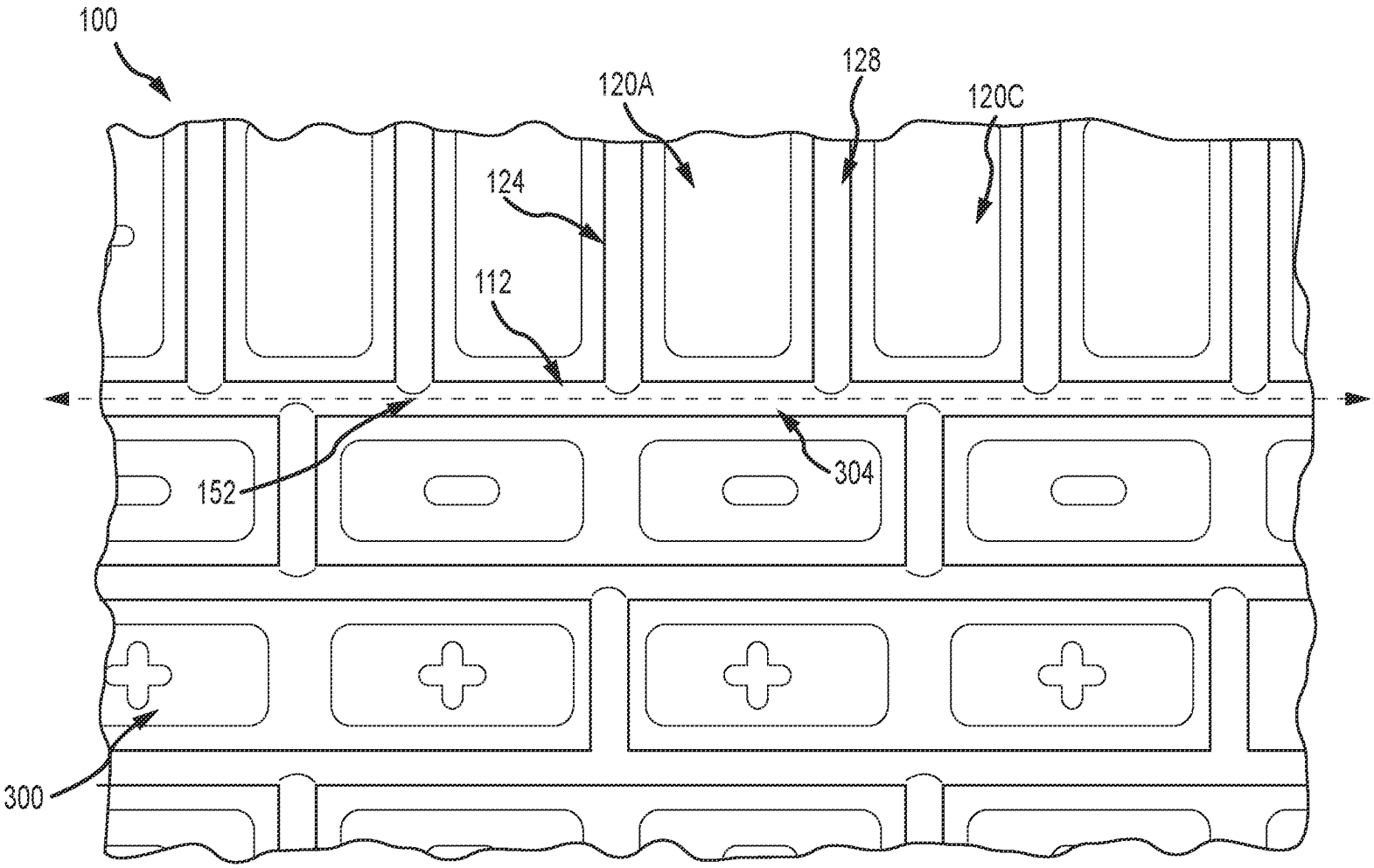
FIG. 4 is a plan view of the adjustable liner, for creating a soldier course of bricks, tile or stone, coupled or connected to a liner, for a field of bricks, tile, or stone, in a cast concrete wall in accordance with embodiments of the present disclosure.
Figure 5:
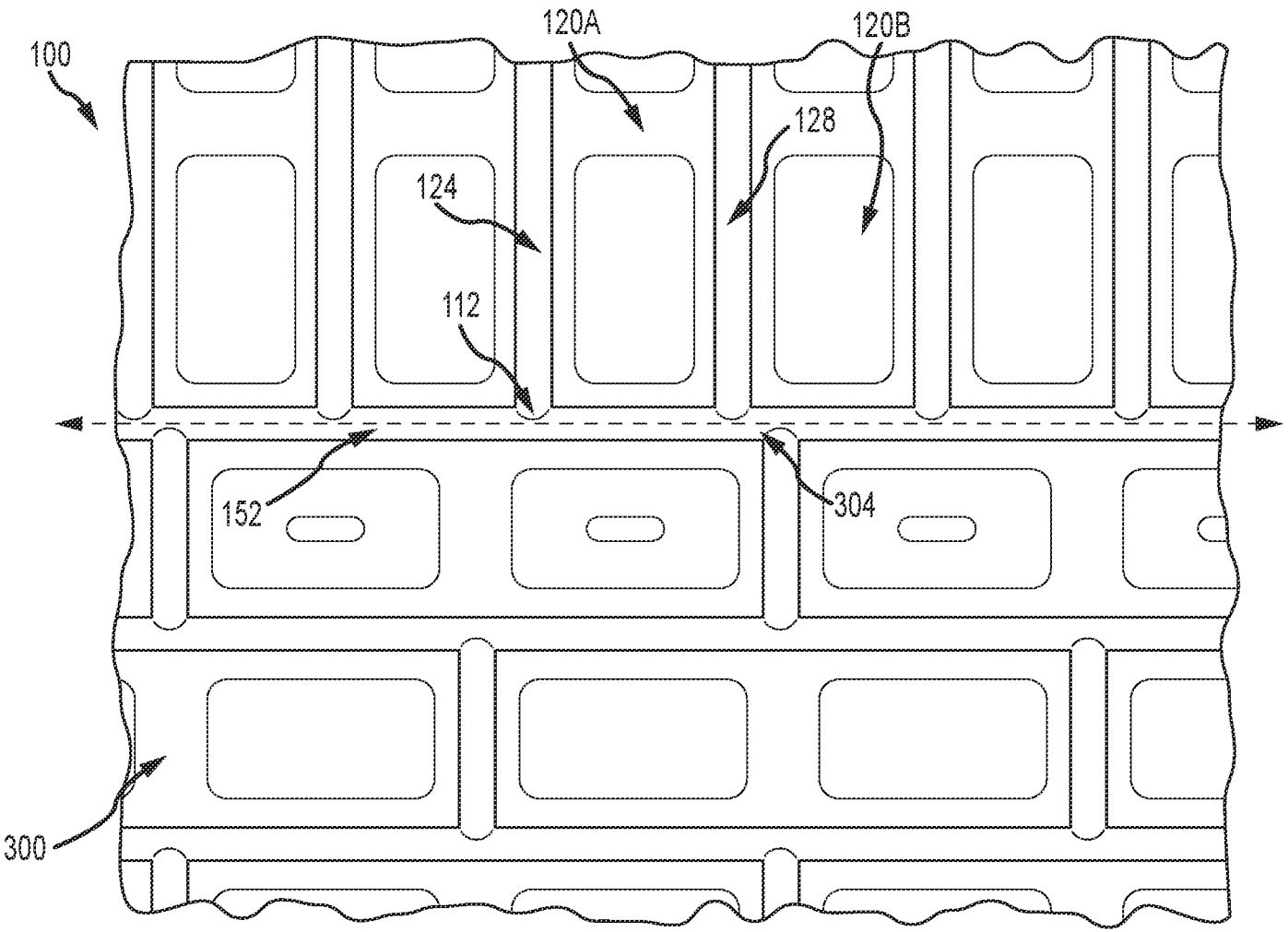
FIG. 5 is a plan view of the adjustable liner, for creating a soldier course of bricks, tile or stone, coupled or connected to a liner, for a field of bricks, tile, or stone, in a cast concrete wall in accordance with embodiments of the present disclosure.

FIGS. 3, 4, & 5 show different configurations of the liner 100 when mated, coupled, and/or connected to the liner 300, which creates the field of brick, tile, or stone. In at least some configurations, the protrusion 136 is placed under and inserted into the rear of the protrusion 304 of the liner 300. The liner 100 may then be moved in either direction along axis 152 to align the soldier course as desired. For example, in FIG. 3, the protrusion 128 of the liner 100 may be aligned with protrusion 308 of the liner 300 to imitate a continuous "grout line" in the final wall. Other alignments are possible, for example, the liner 100 may be moved along axis 152 to create the alignments shown in FIGS. 4 and 5.

Figure 6:
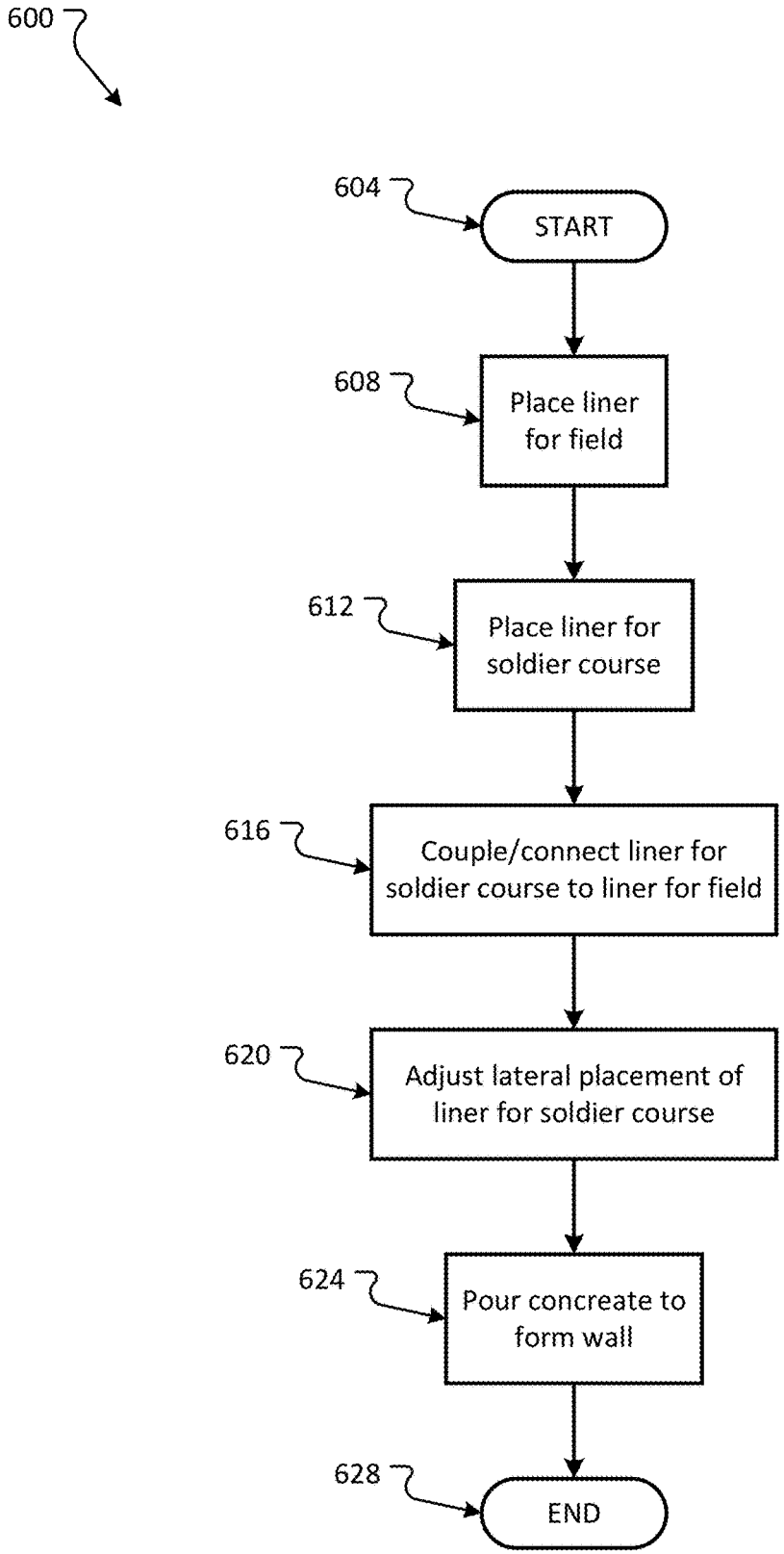
FIG. 6 is a process diagram of a method for creating a cast concrete wall having a soldier course of inlaid brick, tile, or stone in accordance with embodiments of the present disclosure.

A method 600 for creating a wall with inset brick, tile, or stone using the liner 100 may be as shown in FIG. 6. The method 600 can start with a start operation 604 and end with an end operation 628. As a possible first step, a liner 300 for the field of brick or stone may be placed in a mold for a cast concrete wall, in step 608. The liner 300 may be placed at the bottom of the mold before the liquid concrete is poured into the mold. Two or more liners 300 may be placed in the mold.

A liner 100 for the soldier course may then be placed in the mold, in step 612. The liner 100 can be placed along a top or a bottom of a window opening or door opening, along an area that will have a decorative run of brick or stone configured as a soldier course, and/or at other locations depending upon the configuration of the brick, tile, or stone desired for the wall.

The liner 100 may then be coupled, connected, and/or mated with liner 300, in step 616. Thus, the protrusion 136 may be inserted into a rear of a protrusion 304 at a top side (or bottom side) of the liner 300. This mating of the protrusion 136, with protrusion 304, in general, physically connects the liners 100, 300. However, the liner 100 can still move in relation to liner 300 by sliding the liner 100 along axis 152.

In step 620, the liner 100 is slid into position laterally along axis 152. The final position of the liner 100, in relation to liner 300, may be based on the location of the opening or decorative course of brick, tile, or stone. Further, the location of the liner 100 may be adjusted to ensure that no small fragment of brick, tile, or stone are placed next to the soldier course at the first end 104 and/or the second end 108. Thus, the soldier course is adjustable and can be configured as desired by moving the liner 100 along axis 152.

After or while placing all the required liners 100, 300 in the mold, brick, tile, or stone may be inserted into the various insets 120 of the liner 100 and/or liner 300. Once the brick or stone is placed in the mold, liquid concrete may be poured into the mold to form the wall, in step 624. The concrete can flow around the inserted brick, tile, or stone and generally take the shape of the protrusions 124, 128, 304. Once the concrete has hardened, the brick, tile, or stone are held in place by the concrete, and the mold may be removed to expose the liners 100, 300. The liners 100, 300 may then be removed from the brick, tile, or stone to reveal the face of the wall with the brick, tile, or stone embedded in the hardened concrete and in the pattern as created by the liners 100, 300.

The exemplary systems and methods of this disclosure have been described in relation to an adjustable liner for creating a soldier course of brick, tile, or stone in a precast concrete wall. However, to avoid unnecessarily obscuring the present disclosure, the preceding description omits a number of known structures and devices. This omission is not to be construed as a limitation of the scopes of the claims Specific details are set forth to provide an understanding of the present disclosure. It should however be appreciated that the present disclosure may be practiced in a variety of ways beyond the specific detail set forth herein.

Also, while the flowcharts have been discussed and illustrated in relation to a particular sequence of events, it should be appreciated that changes, additions, and omissions to this sequence can occur without materially affecting the operation of the disclosed embodiments, configuration, and aspects.

The phrases "at least one", "one or more", and "and/or" are open-ended expressions that are both conjunctive and disjunctive in operation. For example, each of the expressions "at least one of A, B and C", "at least one of A, B, or C", "one or more of A, B, and C", "one or more of A, B, or C" and "A, B, and/or C" means A alone, B alone, C alone, A and B together, A and C together, B and C together, or A, B and C together.

The term "a" or "an" entity refers to one or more of that entity. As such, the terms "a" (or "an"), "one or more" and "at least one" can be used interchangeably herein. It is also to be noted that the terms "comprising", "including", and "having" can be used interchangeably.

The term "automatic" and variations thereof, as used herein, refers to any process or operation done without material human input when the process or operation is performed. However, a process or operation can be automatic, even though performance of the process or operation uses material or immaterial human input, if the input is received before performance of the process or operation. Human input is deemed to be material if such input influences how the process or operation will be performed. Human input that consents to the performance of the process or operation is not deemed to be "material".

It shall be understood that the term "means" as used herein shall be given its broadest possible interpretation in accordance with 35 U.S.C., Section 112, Paragraph 6. Accordingly, a claim incorporating the term "means" shall cover all structures, materials, or acts set forth herein, and all of the equivalents thereof. Further, the structures, materials or acts and the equivalents thereof shall include all those described in the summary of the invention, brief description of the drawings, detailed description, abstract, and claims themselves.

The present disclosure, in various aspects, embodiments, and/or configurations, includes components, methods, processes, systems and/or apparatus substantially as depicted and described herein, including various aspects, embodiments, configurations embodiments, subcombinations, and/or subsets thereof. Those of skill in the art will understand how to make and use the disclosed aspects, embodiments, and/or configurations after understanding the present disclosure. The present disclosure, in various aspects, embodiments, and/or configurations, includes providing devices and processes in the absence of items not depicted and/or described herein or in various aspects, embodiments, and/or configurations hereof, including in the absence of such items as may have been used in previous devices or processes, e.g., for improving performance, achieving ease and\or reducing cost of implementation.

The foregoing discussion has been presented for purposes of illustration and description. The foregoing is not intended to limit the disclosure to the form or forms disclosed herein. In the foregoing Detailed Description for example, various features of the disclosure are grouped together in one or more aspects, embodiments, and/or configurations for the purpose of streamlining the disclosure. The features of the aspects, embodiments, and/or configurations of the disclosure may be combined in alternate aspects, embodiments, and/or configurations other than those discussed above. This method of disclosure is not to be interpreted as reflecting an intention that the claims require more features than are expressly recited in each claim Rather, as the following claims reflect, inventive aspects lie in less than all features of a single foregoing disclosed aspect, embodiment, and/or configuration. Thus, the following claims are hereby incorporated into this Detailed Description, with each claim standing on its own as a separate preferred embodiment of the disclosure.

Moreover, though the description has included description of one or more aspects, embodiments, and/or configurations and certain variations and modifications, other variations, combinations, and modifications are within the scope of the disclosure, e.g., as may be within the skill and knowledge of those in the art, after understanding the present disclosure. It is intended to obtain rights which include alternative aspects, embodiments, and/or configurations to the extent permitted, including alternate, interchangeable and/or equivalent structures, functions, ranges or steps to those claimed, whether or not such alternate, interchangeable and/or equivalent structures, functions, ranges or steps are disclosed herein, and without intending to publicly dedicate any patentable subject matter.

What is claimed is:

1. A method for creating a precast concrete wall with a building material, the method comprising;

placing a first liner, for creating a field of building material on a first face of the precast concrete wall, into a mold that forms the precast concrete wall;

placing a second liner for creating a decorative course of the building material on the first face of the precast concrete wall, into the mold that forms the precast concrete wall;

mating the second liner to the first liner by inserting a first protrusion formed into a second face at a first side of the second liner into a continuous protrusion formed into a third face at a second side of the first liner;

adjusting the second liner in relation to the first liner to change a configuration of the decorative course with respect to the field;

pouring liquid concrete into the mold;

after the liquid concrete hardens, removing the mold to expose the first and second liners; and removing the first and second liners to expose the building material.

2. The method of claim 1, wherein the building material is a brick, tile, or stone.

3. The method of claim 1, wherein the building material is a veneer.

4. The method of claim 1, further comprising placing the building material into two or more insets formed in the second liner.

5. The method of claim 1, wherein the hardened concrete holds the building material in place.

6. The method of claim 1, wherein the decorative course is formed over an opening in the precast concrete wall.

7. The method of claim 1, wherein the decorative course is a soldier course.

8. The method of claim 1, wherein the second liner is moved along an axis to change a position of the second liner in relation to the first liner.

9. The method of claim 1, wherein two or more second protrusions formed on a periphery of two or more insets in the second liner hold the building material in position.

10. The method of claim 9, wherein the two or more second protrusions form a grout line between the building material in the precast concrete wall.

* * * * *